US008220379B2

(12) United States Patent
Curry

(10) Patent No.: US 8,220,379 B2
(45) Date of Patent: Jul. 17, 2012

(54) CAMOUFLAGE IN THE NEAR ULTRAVIOLET SPECTRUM

(76) Inventor: Reed F. Curry, Wilton, NH (US)

( * ) Notice: Subject to any disclaimer, the term of this patent is extended or adjusted under 35 U.S.C. 154(b) by 0 days.

(21) Appl. No.: 12/946,473

(22) Filed: Nov. 15, 2010

(65) Prior Publication Data

US 2011/0180768 A1 Jul. 28, 2011

Related U.S. Application Data

(60) Provisional application No. 61/298,639, filed on Jan. 27, 2010.

(51) Int. Cl.
*F21V 9/04* (2006.01)

(52) U.S. Cl. ..... 89/938; 89/914; 252/587; 252/588

(58) Field of Classification Search ..... 442/71, 442/66, 69, 74, 75, 79, 85, 86, 89, 131, 170, 442/171, 293; 510/293; 428/209, 195.1, 428/457, 458; 89/938, 914; 252/587, 588
See application file for complete search history.

(56) References Cited

U.S. PATENT DOCUMENTS

| | | | | |
|---|---|---|---|---|
| 4,892,906 | A | 1/1990 | Pham | |
| 4,953,922 | A | 9/1990 | Granqvist | |
| 5,846,614 | A * | 12/1998 | Conner | 428/15 |
| 6,194,329 | B1 * | 2/2001 | Nelson et al. | 442/71 |
| 2004/0266640 | A1 * | 12/2004 | Black | 510/293 |
| 2005/0118402 | A1 * | 6/2005 | Henderson et al. | 428/209 |

OTHER PUBLICATIONS

Stephen Leahy "Getting Burned? Put on a Shirt", [Retrieved on Nov. 2, 2010] Retrieved from the Internet <http://www.wired.com/medtech/health/news/2004/12/65967>GQ Style Manual, Dec. 9, 2004.
Paul E. Burch "The Dye Forum" [Retrieved on Nov. 2, 2010] Retrieved from the internet <http://www.pburch.net/drupal/?q=node/140>, Community of Dyers, May 23, 2006.
WO 2011/094381 International Search Report 3 pgs.
WO 2011/094381 Written Opinion of the International Searching Authority 6 pgs.

* cited by examiner

*Primary Examiner* — Ling Choi
*Assistant Examiner* — Monique Peets
(74) *Attorney, Agent, or Firm* — Daniels Patent Law PLLC; Scott A. Daniels

(57) ABSTRACT

A UV camouflaging substance, in the form of a solid, powder, paste, film, or liquid, can be applied to objects such as fabrics to match the ultraviolet reflectivity of the objects with their immediate surroundings. Embodiments are transparent to visible and IR light, and can be applied without changing the visible appearance of the objects. Other embodiments visibly match the surrounding environment, such as a white substance used near snow. Different embodiments can be layered on top of each other to form UV camouflage textures and to adapt to changing environments. Some embodiments can be washed off, to avoid a build-up of camouflage layers. Embodiments include UV-interactive micro- or nano-particles suspended in a binding agent which transmit, reflect, absorb and/or scatter ultraviolet rays. Some particles are absorbent, while others are approximately one-quarter wavelength thick, and suppress UV light by inducing half-wavelength phase shifts between light reflected from opposing surfaces.

14 Claims, 4 Drawing Sheets

CAMOUFLAGE IN THE NEAR ULTRAVIOLET SPECTRUM

RELATED APPLICATIONS

This application claims the benefit of U.S. Provisional Application No. 61/298,639, filed Jan. 27, 2010, which is herein incorporated by reference in its entirety for all purposes.

FIELD OF THE INVENTION

The invention relates to camouflage, and more particularly to camouflage in the near ultra-violet spectrum.

BACKGROUND OF THE INVENTION

Camouflage is the act of concealing something by modifying its appearance, so that an otherwise visible person or object is either rendered indiscernible from the surrounding environment or simulates an object or entity that is non-threatening to the viewer.

The present state of the art of camouflage is sufficiently effective to have generated a large industry focused on providing camouflage fabrics and clothing in diverse patterns. However, all of these camouflage materials have neglected an important part of the electromagnetic (EM) spectrum. At wavelengths just below the visible range of humans lies the ultraviolet spectrum. Scientists have recently discovered that almost all diurnal bird families, many fish species, some rodents, and some larger mammals, including deer, possess vision in the near-ultraviolet range of the electromagnetic spectrum. The near-ultraviolet spectrum—from 320-400 nm (UVA, henceforth "UV")—complements the human visible spectrum from 400-750 nm.

This extended visual spectrum has not hitherto been taken into consideration by the makers and users of artificial camouflage fabrics. All objects in the natural world reflect some percentage of the ambient ultraviolet light, which can be perceived by an ultraviolet-sensitive viewer. A hunter, for example, will only be concealed from nearby animals if the light reflectivity of the hunter's clothing is similar to the reflectivity of the surrounding background at all wavelengths which are visible to the animals. Similarly, a soldier will only be hidden from antagonists who possess UV vision equipment if the UV reflectivity of the soldier's clothing matches his or her surroundings.

The need for UV camouflage is demonstrated in the animal kingdom. For example, the Arctic fox is white in winter, the same visible color as the ever-present snow. However, the fox's fur also reflects ultraviolet light at approximately eighty-five percent—the same degree of reflection as fresh snow. This is necessary because many of the prey species of the Arctic foxes have vision in the ultraviolet spectrum. Similarly, any attempt at camouflage by humans must provide the proper level of ultraviolet reflection in order to be fully successful in avoiding detection by UV-sensitive animals or by antagonists who possess UV vision equipment.

It can be difficult and/or impractical to provide clothing and/or other fabrics to hunters or soldiers which match both the visible and UV reflectances of various background environments, because environments having similar reflectances in the visible spectrum often have quite different reflectances in the near ultra-violet, and vice-versa. For example, FIG. 1A illustrates a soldier 100 as seen in visible light wearing camouflage clothing 102 which is effective in blending with the surrounding environment 104. In FIG. 1B, the same soldier

100 is shown in ultraviolet light, where the same clothing 102 stands out clearly in contrast with the surrounding vegetation 104, since the clothing reflects more than 50% of the UV light, while the surrounding vegetation reflects less than 10% of the UV. Some examples are presented in Table 1 below of the UV reflectivity of various environmental surfaces.

TABLE 1

DIFFUSE REFLECTION OF NEAR-ULTRAVIOLET FROM SURFACES *

| Surface | Percent Diffuse Reflection |
|---|---|
| Fresh snow | 85 |
| "Dirty" old snow | 50 |
| Dry dune sand | 22 |
| Dry white dune sand | 39 |
| Atlantic beach sand-wet | 9 |
| Sea foam (surf) | 39 |
| Green mountain grassland | 2 |
| Dry, parched grassland | 4.8 |
| Sandy turf | 3.3 |
| Deciduous trees (leaves) | 7 |
| Unpainted wood | 8.3 |
| White cement | 22 |
| Concrete pavement | 15.6 |
| Black asphalt | 11.7 |
| Granite boulder | 70 |
| Rough dark tree bark (oak) | 15 |
| Smooth medium tree bark (aspen) | 50 |
| White birch bark | 70 |
| Water | 5 |

* Compiled from published studies and inventor's research, then averaged.

As a result of these differences in UV reflectivity, a camouflage fabric designed to match one specific environment in both the visible and UV would be unlikely to work well in other environments, even if they looked very similar in the visible range, i.e. to the human eye. Since it is typically impractical for soldiers and hunters to carry many different types of camouflage clothing and coverings, makers of camouflage fabrics have tended to ignore reflectivity in the near ultra-violet, and have focused instead on producing fabrics which work well at visible wavelengths for a wide variety of surrounding environments.

In particular, the military need for camouflage in the UVA spectrum (320-400 nm) has been almost entirely neglected. While some militaries have acknowledged the need to provide supplemental UV camouflage, this has been done only for snow conditions. The most recent U.S. Army Field Manual—FM 20-3 3-5:d—states in Chapter 2 under "Threat":

"The enemy employs a variety of sensors to detect and identify US soldiers, equipment, and supporting installations. These sensors may be visual, near infrared (NIR), IR, ultraviolet (UV), acoustic, or multispectral/hyperspectral. They may be employed by dismounted soldiers or ground-, air-, or space-mounted platforms. Such platforms are often capable of supporting multiple sensors. Friendly troops rarely know the specific sensor systems or combination of systems that an enemy employs . . . ."

And in section 2-16 under "ULTRAVIOLET" the manual states:

"The UV area is the part of the EM spectrum immediately below visible light. UV sensors are more important in snow-covered areas, because snow reflects UV energy well and most white paints and man-made objects do not reflect UV energy very well. Photographic intelligence systems with simple UV filters highlight military targets as dark areas against snow-covered backgrounds. These backgrounds require specially designed camouflage that provides a high UV reflectance . . . .

In Chapter 3, Section I 3-5 d the same manual states under "UV Sensors":

"UV sensors are a significant threat in snow-covered areas. Winter camouflage paint patterns, the arctic LCSS, and terrain masking are the critical means for defending against these sensors; any kind of smoke will defeat UV sensors. Field-expedient measures, such as the construction of snow walls, also provide a means of defeating UV sensors."

Digital technology has created vast improvements in real-time acquisition of UV images. A belligerent can purchase a used camcorder for one hundred dollars over the Internet, and then quickly convert the device to provide clear, real-time imaging in the near-UV/Vis/near-IR; that is, the wavelengths from 330 nm through 1250 nm. By using a lens filter that passes only UV, an enemy can clearly discern fine detail that would not otherwise be visible, including soldiers wearing the most advanced personal camouflage, such as the U.S. Army UCP (Universal Camouflage Pattern) Delta or the recent U.S. Army OCP (Operation Enduring Freedom Camouflage Pattern, a.k.a., MultiCam® by Crye Precision, Inc.). Both of these camouflage patterns stand out boldly in the UV against a background of foliage, as the albedo (percentage of diffuse reflectance) in the UV of green plants averages 3-7% (very dark), while the camouflage reflects, overall, in the range of 20-70% (quite bright). Other environments are just as unforgiving in the ultraviolet. Sandy turf, depending upon the silicates involved, may reflect as little as 3.3% in the UV, while many of the tans and grays used in military and civilian camouflage reflect more than 50% in the UV.

What is needed, therefore, is a system for providing camouflage clothing, coverings, and other fabrics which can match the reflectivity of a variety of background environments at both visible and near ultraviolet wavelengths, without requiring a hunter or soldier to carry burdensome equipment and/or redundant fabrics.

SUMMARY OF THE INVENTION

The present invention is a UV camouflaging substance, in the form of a solid, powder, paste, film, or liquid, which can be applied to a surface so as to alter the ultraviolet reflectivity of the surface so that it approximates the ultraviolet reflectivity of the immediate area. In some embodiments, the substance can be applied without significantly modifying the appearance of the surface in the visible or near-infrared spectrum. In other embodiments, the substance has a visible appearance which will visibly match the surrounding environment, such as a white substance intended for use in snow.

In embodiments, the UV camouflaging substance of the present invention can be easily washed off through use of detergents, and a substance having a different UV reflectivity can be applied as needed, so as to adapt a fabric or other object to changing background environments. Embodiments of the invention thereby provide adaptable camouflage in both the visible and near ultraviolet wavelengths, while avoiding any need for a hunter or a soldier to carry a plurality of garments and/or coverings with differing levels of UV reflectivity.

The immediate utility of this invention to hunters becomes apparent when one considers that deer, ducks, wild turkeys, and many other animals sought by hunters or naturalists currently see modern human camouflage attempts as large, potentially-frightening anomalies in the ultraviolet landscape. The utility to combatants is clear, since soldiers in the field must often traverse a variety of differing terrains, and the UV sensing capabilities of belligerents can frequently be only guessed.

In some of these embodiments the invention includes UV-interactive particles which transmit, reflect, absorb and/or scatter ultraviolet rays, and a binding agent which attaches the UV-interactive particles to the fabric, which itself may, or may not, also include or inherently be a UV absorber or reflector.

In various embodiments, the UV-interactive particles are inorganic, organic, or metallic. Examples of UV-interactive particles that are used in various embodiments include, but are not limited to, earth pigments, talc, metal oxides, metallic hydroxides, mixed metal oxides and hydroxides, metal and mixed metal silicates and aluminosilicates, transition metal oxides and hydroxides, iron oxides, natural clay, metal sulfides, non-metallic elements, natural polymers, and insoluble organic materials.

Microfine metal oxides in particular possess the unique property of being transparent to visible light but opaque to UV radiations. The opacity of a suspension of fine material is influenced by the particle size of the material, the difference in the refractive indices of dispersed material and the dispersing medium and the wavelength of the light. Refractive index (RI) measures the speed of light in the given substance relative to speed of light in air. Light scatter within any medium is a function of difference in the RI's between the pigment and the medium. If the ratio of the RI's is close to 1, the whole system has a transparent appearance. In contrast, the entire system has a white appearance if the ratio is significantly greater than 1. For example, the RI of ZnO is 1.9 whereas that of $TiO_2$ is 2.6 making it whiter in appearance.

The RI of a material is intrinsic to that material and is a fixed characteristic. However, it can be minimized by one of two ways: either by using a suspending medium with an RI similar to that of the material, or by manipulating the particle size of the material. The first method is limited due to a lack of availability and transparency of such suspending media. Hence, the only remaining option, that of reduction of particle size, is exploited in embodiments of the present invention to reduce the opacity of the UV-interactive particles, such as metal oxide particles. In particular, particles less than 0.25 microns in size actually transmit more visible light than their larger counterparts.

In some embodiments, the UV-interactive particles have an average diameter of 90 nm, while in other embodiments the diameters range from 50 microns to as small as 5 nm. The UV-interactive particles in various embodiments are odorless, non-soluble or minimally-soluble in water, nearly transparent to visible and near-IR wavelengths, consistent in reflectivity in the 320 nm-400 nm range, non-flammable, non-oxidizing, non-toxic, low agglomeration, non-flocculating, and/or non-allergenic.

Certain embodiments of the present invention are based upon the science of thin-film optical filters, which selectively reflect or suppress discrete wavelengths of light, in this case the near ultraviolet range from 320 nm to 400 nm, while permitting visible light—400 nm to 750 nm—to pass back and forth transparently through the substance. This enables embodiments of the invention to be applied in the field on differing types of fabric without affecting the desirable characteristics of the fabric in the visible spectrum. Some of these embodiments include nanoparticles having an average size of approximately 90 nm, which is approximately equal to one-quarter of the wavelength of the near UV frequencies which are to be suppressed. At such small sizes, particles for example made from titanium dioxide are substantially transparent to visible light.

While many embodiments are primarily concerned with the percentage of ultraviolet light which is reflected, some embodiments give consideration to another aspect of thin film optical filters, that of interference. The use of 90 nm particles is necessary with some compounds, though not all, because if the particles were, for example, 140 nm in size, the incident visible light at 560 nm (green) might tend to reflect off of both surfaces of the particles, and the near quarter wavelength thickness of the particles might lead to a nearly one-half wavelength phase offset between the light reflected from the two surfaces, leading to a partial cancellation of the reflected visible light. Thus, this interference would alter the visible appearance of the camouflage, making it appear less green Some embodiments include a film or binding agent which binds the particles to the fabric or surface. Binding agents used in various embodiments include, but are not limited to, casein isolate, soy protein isolate, starch, starch derivatives, glycol, propylene glycol, resins, latex, synthetic latexes, and gums.

The UV-interactive particles and associated binder in various embodiments can be applied to the fabric or to other object by any of several methods. In some embodiments a suspension of particles and binder in a neutral solvent such as water can be applied to a garment fabric either prior to garment manufacture or after the garment is finished. In other embodiments the carrier/solvent is a more volatile liquid such as alcohol or mineral spirits.

In still other embodiments, the UV-interactive particles and binder can be applied to fabrics using finishing techniques known to the industry. In still other embodiments, the UV-interactive particles and binder can be applied to finished garments using a spray or dip coating, soaking, or similar method. And in yet other embodiments the particles and binder can be applied during the washing or laundering of clothing, e.g. at the rinse cycle.

Embodiments of the present invention can be produced as an aqueous solution to be sprayed upon fabric, while other embodiments can be provided in concentrated form to be added to water in the field, thus saving weight and space. Prior to the addition of water, the mixture of UV-interactive particles and binding agent in some embodiments can be in powder, tablet, paste, gel, or liquid form, and can be delivered from a sachet, bottle, tube, or other transport mechanisms.

Some embodiments of the present invention can be produced as a gel stick, similar to a deodorant stick, wherein the user applies the invention to the fabric in strokes. And certain embodiments of the present invention provide a surface treatment that is fire-resistant and/or fire-retardant.

One general aspect of the present invention is a system for providing camouflage protection at near ultraviolet wavelengths to an object surrounded by an environment. The system includes a UV camouflage substance which is applicable to a surface of the object, the substance having an ultraviolet reflectivity which is similar to an ultraviolet reflectivity of the environment.

In some embodiments, the UV camouflage substance is substantially transparent to visible light. And in certain embodiments the UV camouflage substance is substantially transparent to infrared light. In various embodiment, the UV camouflage substance includes a substance which absorbs ultraviolet light.

In some embodiment, the UV camouflage substance includes UV-interactive particles suspended in a binding agent. In some of these embodiments the UV-interactive particles absorb ultraviolet light. In other of these embodiments an average dimension of the UV-interactive particles is about approximately 90 nanometers, such that reflection of UV light from opposing boundaries of the particles produces reflected UV light having a phase difference of approximately one half wavelength, the reflected light thereby tending to cancel and to be thereby suppressed. In still other of these embodiments an average dimension of the UV-interactive particles is between 5 nanometers and 50 microns.

In various embodiments the UV camouflage substance can be applied as a spray. In other embodiments, the UV camouflage substance can be applied as part of a manufacturing process. In certain embodiments, the UV camouflage substance can be removed from the object through a washing process.

In some embodiments, the ultraviolet light has a wavelength which is between 320 and 400 nanometers.

In various embodiments, the object is a fabric object. In some of these embodiments, the object is clothing, webbing, or netting.

In some embodiments the UV camouflage substance is a liquid, a gel stick, a paste, a foam, a film, a powder, or a solid. In certain embodiments the UV camouflage substance can be applied to the object by spraying, rubbing, brushing, sponging, rollering, pouring, immersing, applying pressure, and/or heating.

In certain embodiments, the UV camouflage substance can be transported in a concentrated form and then diluted immediately before application.

In various embodiments, the system includes a plurality of UV camouflage substances, the UV camouflage substances being applicable to the object in successive layers, wherein the topmost layer determines the UV reflectivity of the object.

Another general aspect of the present invention is a method for providing camouflage protection at near ultraviolet wavelengths to an object surrounded by an environment. The method includes providing a plurality of UV camouflage substances having distinct UV reflectivities, determining a UV reflectivity of the environment, selecting from the plurality of UV camouflage substances a UV camouflage substance having a UV reflectivity which is at least similar to the UV reflectivity of the environment, and applying the selected UV camouflage substance to the object.

In various embodiments, the method further includes applying a plurality of the UV camouflage substances to the object in a pattern which approximates a visual pattern of the environment when viewed using ultraviolet sensitive vision apparatus.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

As indicated above, the present invention is a UV camouflage substance which can be applied to fabrics and to other objects to provide camouflage in the near-UV spectrum by matching the UV reflectivity of the object in the UV spectrum with the surrounding environment. In various embodiments, the UV camouflage substance of the present invention is substantially transparent to visible and IR light, and can therefore be applied to clothing or to another object without affecting the visible appearance of the object, and therefore without affecting any camouflage properties which the object possesses in the visible spectrum. The invention is applicable to a hunter, soldier, naturalist, object of military significance, or any other object or individual which requires camouflage in the UV spectrum.

The UV camouflage substance of the present invention can be used to match the UV reflectivity of an object with its background or surroundings, so that the ultraviolet albedo of the object approximates the ultraviolet albedo of the object's background or surroundings. Such objects include, but are not limited to, humans, animals, and man-made objects. For some embodiments, the substance is substantially transparent to visible and near-IR light, and can be applied to objects which are already camouflaged in the visible and near-IR bands of the electromagnetic spectrum without affecting those properties.

The methodology of the present invention is suited for camouflaging objects in the UV in all natural or man-made terrestrial environments, including but not limited to temperate forests, upland meadows, open fields, deserts, swamps, marshlands, snow-fields, mountains, and urban environments. Table 1 above presents UV reflectivity values for some of the environments to which the current invention is applicable.

Figure 1A:
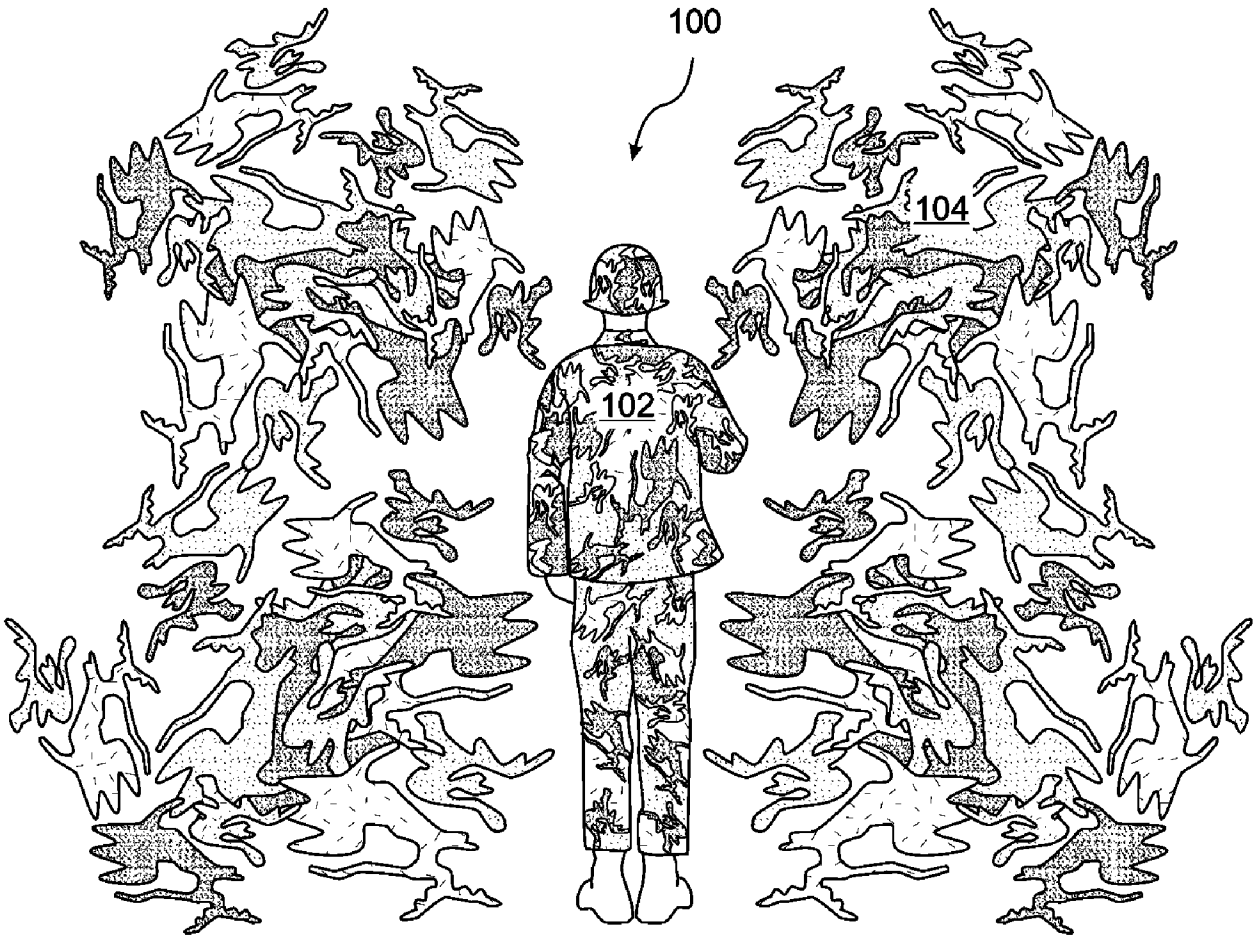
FIG. 1A is a perspective view of a hunter surrounded by vegetation while wearing camouflage clothing as seen in visible light.
Figure 1B:
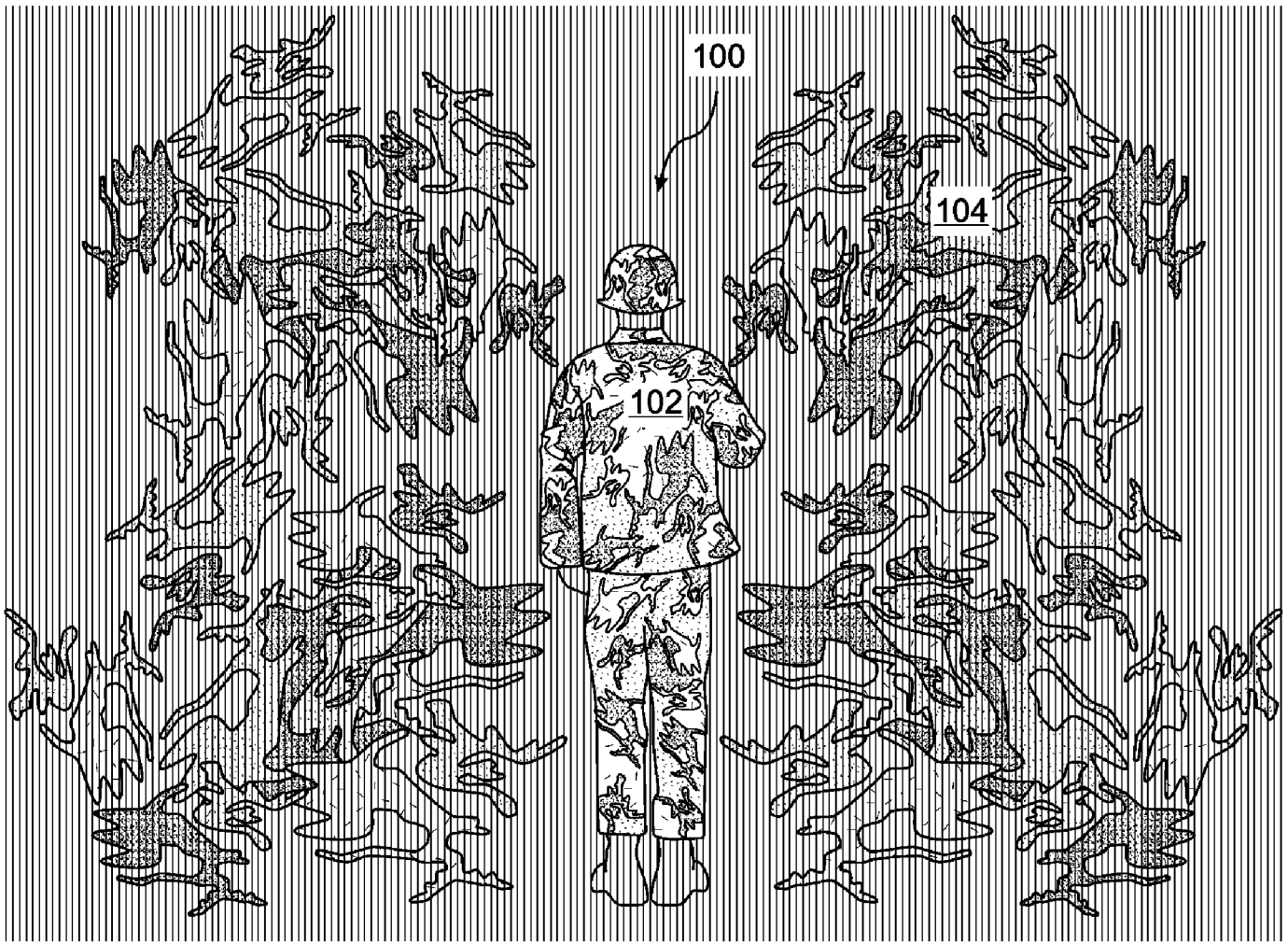
FIG. 1B is a perspective view of the hunter of FIG. 1A as seen through a filter which passes only ultraviolet light.

As discussed above, FIGS. 1A and 1B illustrate the ineffectiveness of a conventional camouflage jacket in the UV spectrum (FIG. 1B) even though the clothing 102 functions well as camouflage in the visible spectrum (FIG. 1A). In the example of FIGS. 1A and 1B, this is due to the fact that surrounding vegetation is typically much more absorbent at UV wavelengths than for visible light, while the pigments and fabrics typically employed in visible camouflage have high reflectivity for both visible and UV light (see Table 1 above).

Figure 2:
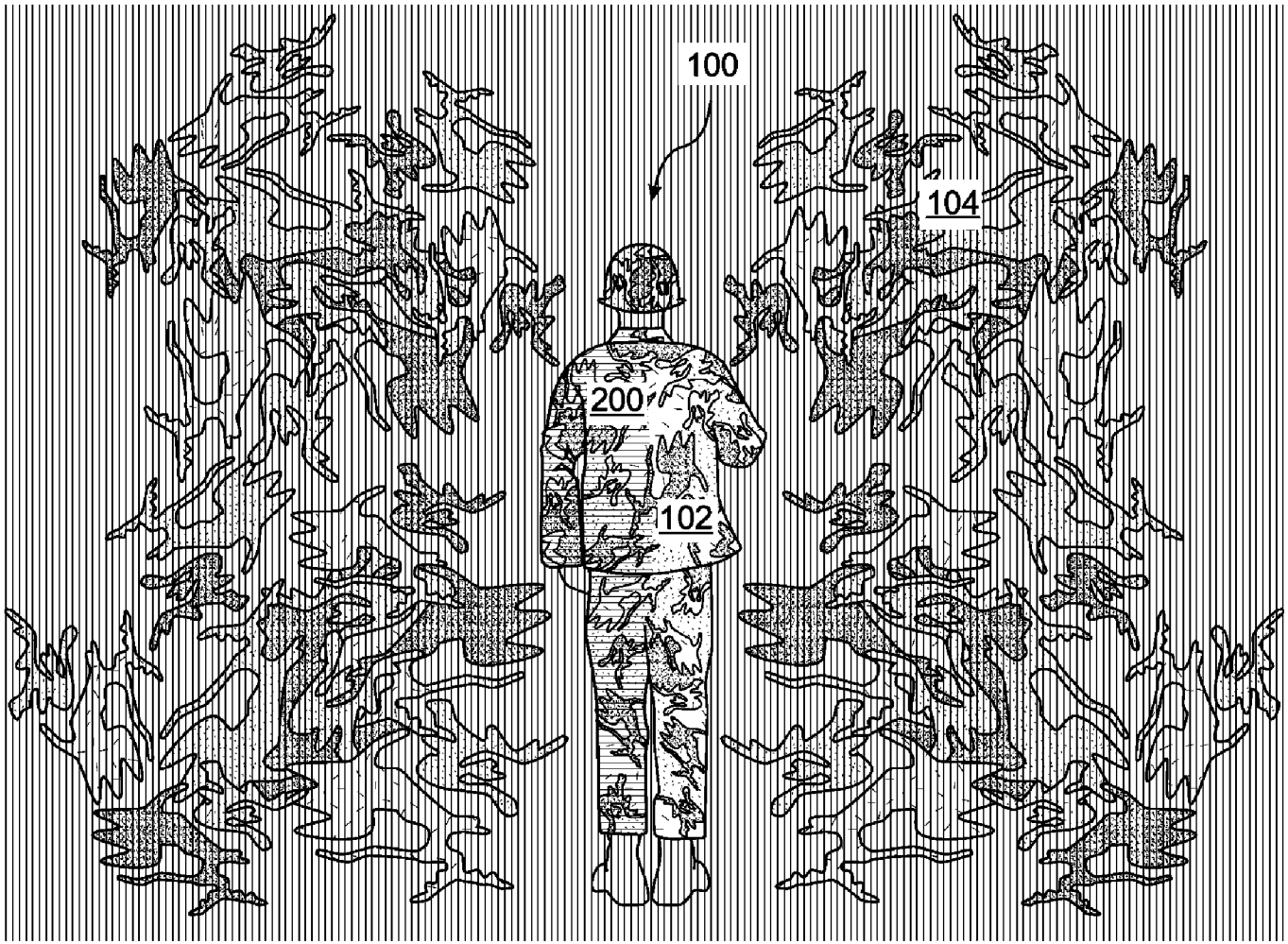
FIG. 2 is a perspective view of the hunter of FIG. 1A surrounded by vegetation while wearing camouflage clothing as seen as seen through a filter which passes only ultraviolet light, the clothing of the hunter having been treated with the present invention on one side only.

FIG. 2 illustrates a view using ultraviolet vision equipment of the camouflage clothing 102 and surroundings 104 of FIG. 1B, wherein an embodiment of the present invention has been applied to only the left half 200 of the camouflage clothing 102. It can be clearly seen from the figure that the UV reflectivity of the left half 200 of the clothing 102 has been significantly reduced as compared to the right half, and has been closely matched to the reflectivity of the surrounding vegetation 104.

In some embodiments, the UV camouflage substance of the present invention is insoluble in water, and is essentially permanent, once it has been applied. In other embodiments the UV camouflage substance is water soluble, and can be easily removed by a simple washing process with detergent. This enables a user to adjust the UV reflectivity of a treated object as needed. For example, the hunter 100 of FIG. 2 (or a soldier) could apply one embodiment to his or her clothing 102 to match the reflectivity of surrounding vegetation 104, as shown in FIG. 2, and could subsequently wash that embodiment off and apply another embodiment of the UV camouflage substance with increased UV reflectivity so as to hunt in a different environment, such as in rocky or dirt-covered surroundings, which have a higher UV reflectivity than vegetation. If the soldier were then required to move back into an environment filled with vegetation, the soldier 100 could remove the second embodiment by washing, and then reapply the first embodiment so as to once again match the clothing 102 to the UV reflectivity of the surroundings 104. Or as an alternative, the soldier could forego removing the first film and apply a second film over the first; the reflectivity of the top layer being always dominant. This principle applies equally to vehicles, tents, covering tarps, and to any object which a user wishes to camouflage.

Some embodiments of the present invention are also partly or fully opaque at visible and/or infrared wavelengths. Some of these embodiments can provide visible camouflage, for example a white substance which also matches the UV reflectivity of snow. Other embodiments of the present invention absorb or reflect light in the near UV, while being substantially transparent to visible light and thereby having little if any effect on the visible appearance of objects to which they are applied. This enables embodiments of the invention to be applied in the field on differing types of fabric 308 without affecting the desirable characteristics of the fabric 308 in the visible spectrum.

Figure 3:
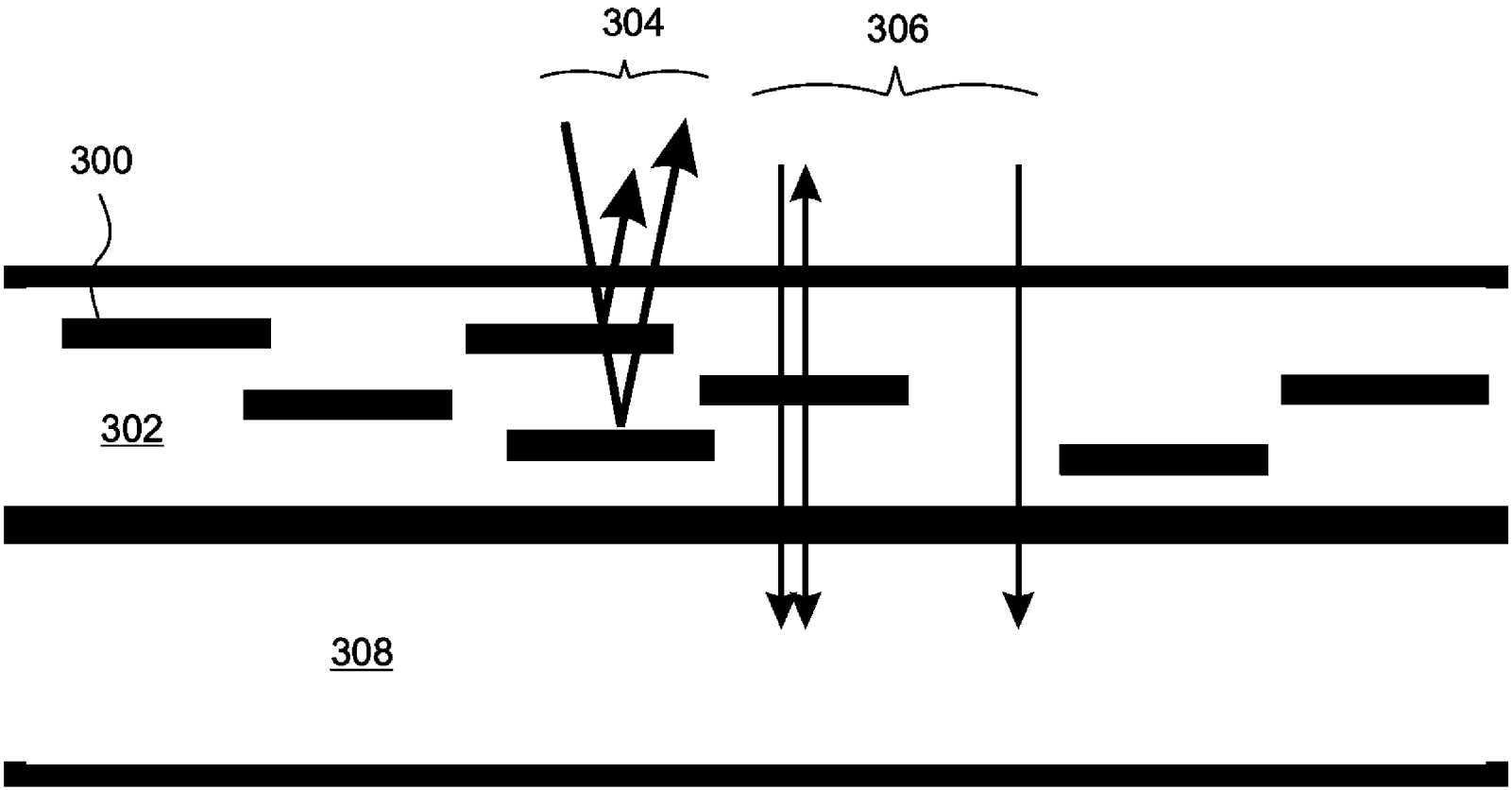
FIG. 3 is a cross-sectional diagram illustrating the particles and binder of an embodiment of the present invention attached to the surface of a conventional camouflage fabric.

With reference to FIG. 3, in various embodiments the present invention includes UV-interactive particles 300 which are suspended in an aqueous solution before application, and which form a deposited thin film 302 when the applied solution evaporates. In certain of these embodiments, the aqueous solution 302 includes a natural binder such as gum Arabic, an anti-fungicide with fire-retardant properties such as sodium bicarbonate, and a surfactant such as Polysorbate 20.

In some of these embodiments, UV light is reflected by the particles 300. In other of these embodiments, UV light 304 is absorbed or scattered by the particles. In some of these embodiments, as shown in FIG. 3 (item 304), the absorption of UV light 304 is based at least partly upon the science of thin-film optical filters, which selectively reflect discrete wavelengths of light, in this case the near-ultraviolet range from 320 nm to 400 nm, while permitting visible light—410 nm to 750 nm—to pass back and forth transparently through the substance.

Some of these embodiments include nanoparticles 300 having an average size of approximately 90 nm, which is approximately equally to one-quarter of the wavelength of the near-UV frequencies which are to be suppressed 304. At such small sizes, particles 300 are substantially transparent at the longer wavelengths of visible light and infrared light 306, but are highly absorptive at near-UV wavelengths. However, light at shorter UV wavelengths 304 tends to reflect off of both the front and rear surfaces of the particles, and the near quarter-wavelength thickness of the particles 300 leads to a one-half wavelength phase offset between UV light reflected from the two surfaces 304, causing absorption of the UV light due to at least a partial cancellation of the UV light reflected from the two surfaces.

In various embodiments the UV-interactive particles are inorganic, organic, or metallic. Examples of particles that are used in various embodiments include, but are not limited to, earth pigments, talc, metal oxides, metallic hydroxides, mixed metal oxides and hydroxides, metal and mixed metal silicates and aluminosilicates, transition metal oxides and hydroxides, iron oxides, natural clay, metal sulfides, non-metallic elements, natural polymers, and insoluble organic materials.

In some embodiments the UV-interactive particles 300 have a diameter of 90 nm, while in other embodiments the diameters range from 50 microns to as small as 5 nm. The particles 300 in various embodiments are odor-less, non-soluble or minimally-soluble in water, nearly transparent to visible and near-IR wavelengths, consistent in reflectivity in the 320 nm-400 nm range, non-flammable, non-oxidizing, non-toxic, low agglomeration, non-flocculating, and/or non-allergenic.

Following are three specific formulas for three embodiments of the present invention, including instructions for their preparation. It will be understood that these embodiments are intended to be representative only, and that the invention is not limited to these specific embodiments.

Formula 1: 7% Ultraviolet Reflectivity

| | | |
|---|---|---|
| Distilled water | 48.2% | 294.0 g |
| Gum Arabic-mixed 10 g in 30 g water | 2.9% | 18.0 g |
| Tinosorb FD-30 g in 300 g water * | 48.2% | 294.0 g |
| Polysorbate 20 | 0.482% | 3.0 g |
| Sodium Bicarbonate-mixed with gum Arabic; | 4% by weight of dry gum Arabic | |

* In some embodiments, approximately about 10 g of the UV-active ingredient in Tinosorb FD, which is benzenesulfonicacid,2,2'-(1E)-1,2-ethenediylbis[5-[[4-(methylamino)-6-[[4-[(methylamino)carbonyl]phenyl]amino]-1,3,5-triazin-2-yl]amino]-, sodium salt (1:2), also known as CAS: 180850-95-7, is added in place of the 30 g of Tinosorb FD.

Note that, in this example, the Tinosorb FD is the UV-interactive ingredient, which absorbs a high percentage of ultraviolet light, while being mainly transparent to visible and infrared light.

Steps for preparing this formula for spray application include:

1. Pour distilled water into batch mixing tank.
2. Premix in separate container Gum Arabic in water to make solution.
3. Allow Gum Arabic to completely dissolve—approximately one hour.
4. Add Sodium Bicarbonate to Gum Arabic solution, stir well. (Acts as fungicide)
5. Premix in separate container distilled water with Tinosorb FD to make suspension.
6. Add Gum Arabic solution, Polysorb 20, and Tinosorb FD suspension to batch mixing tank.
7. Stir well and keep stirring.
8. Dispense to individual bottles—24 gal of product makes approximately 139—22 oz bottles.

Note that Tinosorb FD contains 40% Sodium sulfate, which adds stiffness to the fabric and allows the BENZENESULFONIC ACID,2,2 (CAS: 180850-95-7) to penetrate. Due to this penetration, approximately 50% of the Tinosorb is ineffective. As an alternative, pure BENZENESULFONIC ACID,2,2 (CAS: 180850-95-7) can be substituted for the Tinosorb FD with the amount of dry BENZENESULFONIC ACID being half that which would be required when using Tinosorb FD.

Formula 2: 22% Ultraviolet Reflectivity

| | |
|---|---|
| Distilled water | 308 g |
| Gum Arabic-mixed 10 g in 30 g water | 25 g |
| Titanium dioxide-10 g in 100 g water | 219 g |
| Gold Ochre GG-10 g in 100 g water | 71 g |
| Sodium Bicarbonate-mixed with gum Arabic; | 4% by weight of dry gum Arabic |

Note that, in this example, the Titanium dioxide has a particle size of approximately 90 nanometers, and interacts with ultraviolet light in a manner similar to a thin film optical filter. The Gold Ochre GG contains iron oxide which is highly absorptive of UV light, while being only slightly absorptive in the visible and infrared range, and is included so as to decrease the overall reflectivity of the substance.

Steps for preparing this formula for spray application include:

1. Pour distilled water into batch mixing tank.
2. Premix in separate container Gum Arabic in water to make solution.
3. Allow Gum Arabic to completely dissolve—approximately one hour.
4. Add Sodium Bicarbonate to Gum Arabic solution. (Acts as fungicide)
5. Premix in separate container distilled water with TiO2 (nano-particles) to make solution.
6. Premix in separate container distilled water with Yellow Ochre Sahara to make solution.
7. Add Gum Arabic solution, Yellow Ochre suspension, and TiO2 suspension to batch mixing tank.
8. Stir well and keep stirring.
9. Dispense to individual bottles—24 gal of product makes approximately 139—22 oz bottles.

Formula 3: 50% Ultraviolet Reflectivity

| | |
|---|---|
| Distilled water | 343 g |
| Gum Arabic-mixed 10 g in 30 g water | 25 g |
| MgSiO2-mixed 20 g in 100 g water | 249 g |
| Sodium Bicarbonate-mixed with gum Arabic; | 4% by weight of dry gum Arabic |

Note that, in this example, the MgSiO2 has a particle size of approximately 80 nanometers, and interacts with ultraviolet light in a manner similar to a thin film optical filter.

Steps for preparing this formula for spray application include:

1. Pour distilled water into batch mixing tank.
2. Premix in separate container Gum Arabic in water to make solution.
3. Allow Gum Arabic to completely dissolve—approximately one hour.
4. Add Sodium Bicarbonate to Gum Arabic solution. (Acts as fungicide)
5. Premix in separate container distilled water with MgSiO2 (nano-particles) to make suspension.
6. Add Gum Arabic solution and MgSiO2 suspension to batch mixing tank.
7. Stir well and keep stirring.
8. Dispense to individual bottles—24 gal of product makes approximately 139—22 oz bottles.

Note that all of these formulae can be adjusted so as to provide the substance in a dried or nearly dried format (e.g. paste or powder format), to be diluted immediately before application.

Following are two formulae for gel "deodorant stick" embodiments. These embodiments are applied to the fabric in direct-contact strokes. The gel stick can be extended further from the container as necessary. As noted above, these embodiments are presented as illustrative examples only, and do not limit the invention in any way.

7% Reflectivity

| | | |
|---|---|---|
| 1 | Sodium hydroxide | 1.0 g |
| 2 | Sodium Stearate | 5.00 g |
| 3 | Distilled water | 100.00 g |
| 4 | Propylene Glycol | 40.0 g |
| 5 | Alcohol 96%. Q.S. ad. | 5.00 g |
| 6 | Payne's Gray 2 g mixed with 200 g water | 5.0 g |
| 7 | Zinc oxide-nanoparticles | 5.0 g |

25% Reflectivity

| | | |
|---|---|---|
| 1 | Sodium Hydroxide | 1.0 g |
| 2 | Sodium Stearate | 5.0 g |
| 3 | Distilled water | 100.00 g |
| 4 | Propylene Glycol | 40.0 g |
| 5 | Alcohol 96% | 3.00 g |
| 6 | Payne's Gray 2 g mixed with 200 g water | 3.0 g |
| 7 | Talc (nanoparticles) | 15.00 g |

Preparative Procedure for Both Formulae:

To the main vessel—a double boiler type—with appropriate mixing and handling capabilities, add 1, 3 and 4, start mixing and heat to 70° C. Then slowly add 2 (to prevent clumping). When the batch is crystal clear and completely free of undissolved 2, correct for any water loss, add 6, and then commence very slow cooling (to prevent set up of the product on the vessel walls) with strong mixing without aeration. At 60° C. add 7. Continue mixing and fill product when uniform and about 3° C. above the melt point of the product of 51 C.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for providing camouflage protection at near ultraviolet wavelengths to an object surrounded by an environment, the system comprising a UV camouflage substance which is applicable to a surface of the object, the substance having a predetermined percentage of ultraviolet reflectivity which is similar to a percent reflection of ultraviolet light in the environment; and wherein the UV camouflage substance is substantially transparent to visible light and near-infrared light and the UV camouflage substance includes UV-interactive particles suspended in a thin film on the surface of the object.

2. The system of claim 1, wherein an average dimension of the UV-interactive particles is about 90 nanometers, such that reflection of UV light from opposing boundaries of the interactive particles produces interference-blocking only within the near-ultraviolet range and does not interfere with the visible or near-infrared appearance of the camouflaged object.

3. The system of claim 1, wherein an average dimension of the UV-interactive particles is between 5 nanometers and 50 microns.

4. The system of claim 1, wherein the UV camouflage substance can be applied as a spray.

5. The system of claim 1, wherein the UV camouflage substance can be applied as part of a manufacturing process.

6. The system of claim 1, wherein the UV camouflage substance can be removed from the object through a washing process.

7. The system of claim 1, wherein the ultraviolet light has a wavelength which is between 320 and 400 nanometers.

8. The system of claim 1, wherein the object is a fabric object.

9. The system of claim 8, wherein the object is one of clothing, webbing, and netting.

10. The system of claim 1, wherein the UV camouflage substance is one of a liquid, a gel stick, a paste, a foam, a film, a powder, and a solid.

11. The system of claim 1, wherein the UV camouflage substance can be applied to the object by at least one of spraying, rubbing, brushing, sponging, rollering, pouring, immersing, applying pressure, and heating.

12. The system of claim 1, wherein the UV camouflage substance can be transported in a concentrated form and then diluted immediately before application.

13. The system of claim 1, wherein the system includes a plurality of UV camouflage substances, the UV camouflage substances being applicable to the object in successive layers, wherein the topmost layer determines the UV reflectivity of the object.

14. A system for providing camouflage protection at near ultraviolet wavelengths to an object surrounded by an environment, the system comprising a UV camouflage substance which is applicable to a surface of the object, the substance having a predetermined percentage of ultraviolet reflectivity which is similar to a percent reflection of ultraviolet light in the environment; and wherein the UV camouflage substance is substantially transparent to visible light and the UV camouflage substance includes UV-interactive particles suspended in a thin film on the surface of the object.

* * * * *